United States Patent [19]

Tatsuda et al.

[11] Patent Number: 4,972,116

[45] Date of Patent: Nov. 20, 1990

[54] LIGHT SOURCE DISPLAY TUBE

[75] Inventors: Kazunori Tatsuda; Masaaki Kobayashi; Mitsuru Masuda; Hiroshi Kamogawa, all of Mie; Zenichiro Hara, Nagasaki; Nobuo Terazaki, Nagasaki; Shunichi Futatsuishi, Nagasaki; Norihiro Ichikawa, Nagasaki; Shiji Iwata, Hyogo, all of Japan

[73] Assignees: ISE Electronics Corporation, Ise; Mitsubishi Denki Kabushiki Kaisha, Tokyo, both of Japan

[21] Appl. No.: 318,329

[22] Filed: Mar. 3, 1989

[30] Foreign Application Priority Data

| | | | |
|---|---|---|---|
| Mar. 15, 1988 | [JP] | Japan | 63-60757 |
| Mar. 15, 1988 | [JP] | Japan | 63-60758 |
| Mar. 15, 1988 | [JP] | Japan | 63-60753 |
| Mar. 15, 1988 | [JP] | Japan | 63-60751 |
| Mar. 31, 1988 | [JP] | Japan | 63-79518 |
| Mar. 31, 1988 | [JP] | Japan | 63-79517 |

[51] Int. Cl.[5] ..... H01J 29/00; H01J 29/50

[52] U.S. Cl. ..... 313/422; 313/497

[58] Field of Search ..... 313/495, 497, 496, 422

[56] References Cited

U.S. PATENT DOCUMENTS

| | | | |
|---|---|---|---|
| 3,532,921 | 10/1970 | Akabane et al. . | |
| 4,308,484 | 12/1981 | Carroll | 313/422 X |
| 4,608,518 | 8/1986 | Fukuda et al. | 313/495 |
| 4,692,663 | 9/1987 | Kobayashi et al. | 313/495 |

FOREIGN PATENT DOCUMENTS

| | | | |
|---|---|---|---|
| 0217003 | 4/1987 | European Pat. Off. . | |
| 0016457 | 1/1983 | Japan | 313/495 |
| 62-10849 | 1/1987 | Japan . | |
| 2170351 | 7/1986 | United Kingdom . | |

*Primary Examiner*—Palmer C. DeMeo

*Attorney, Agent, or Firm*—Burns, Doane, Swecker & Mathis

[57] ABSTRACT

A light source display tube arranged in matrix form in one plane as a unit element to constitute a large screen display device, where a stray path for electrons emitted from the cathode is eliminated, and concentration of the electric field of the control grid disturbing the electron flow is prevented, thereby pseudo light emission is prevented and electrical trouble is minimized in simple fashion.

10 Claims, 9 Drawing Sheets

LIGHT SOURCE DISPLAY TUBE

BACKGROUND OF THE INVENTION

1. Field of the Invention

The present invention relates to a large screen display device, more particularly to a light source display tube to constitute a picture element of a color display device.

2. Description of the Prior Art

When a monochromatic display tube utilizing light emission of fluorescent material forms a single picture element and such monochromatic display tubes are arranged in matrix form to constitute a large screen display device, a disadvantage occurs in that a space is produced on the connecting portion of each monochromatic display tube, thereby, improvement of resolving power is difficult, and high resolving power may be accompanied by high cost.

Consequently, in the prior art, a light source display tube surmounting the above-mentioned disadvantage is disclosed in a light source display tube which was invented by Kobayashi et al. and filed in the Japanese Patent Office by Ise Denshi Kogyo Co., Ltd. on July 8 , 1985 and laid open on Jan. 19, 1987as Japanese Patent Laid-Open Publication No. 62-10849.

The light source display tube in the prior art is shown in a front view of FIG. 1, a lateral sectional view of FIG. 2 and an exploded perspective view of FIG. 3. The figures show the case wherein a fluorescent screen having respective fluorescent materials of R (red), G (green) and B (blue) each forming one picture element is arranged in matrix form having 3×3 picture elements in number.

In these figures, numeral 1 designates as a vacuum envelope a glass tube which is hermetically sealed by a front panel 2, a back plate 3 and a rectangular side plate 4. On the inner surface of the front panel 2 is formed a fluorescent display member 5 which is arranged and coated in matrix form using three-color fluorescent materials R, G, B each forming a unit picture element, and comprises fluorescent screens 5R, 5G and 5B of the 3×3 picture elements, wherein suffixes of the fluorescent screens 5R, 5G and 5B correspond to red (R), green (G) and blue (B) respectively.

Numeral 6 designates an anode electrode group comprising a plurality of accelerating anodes $6_1$, $6_2$, . . . arranged corresponding to a periphery of the fluorescent screens 5R, 5G and 5B of the fluorescent display member 5 respectively, and a high voltage is applied to these accelerating anodes $6_1$, $6_2$, . . . through an external terminal 16.

Numeral 7 designates a cathode electrode group comprising cathodes $7_{11}$–$7_{33}$ for electron emission ($7_{13}$, $7_{23}$, $7_{31}$, $7_{32}$ and $7_{33}$ not being shown) respectively arranged independently corresponding to each of the fluorescent screens 5R, 5G, 5B of the fluorescent display member 5, and these cathodes $7_{11}$–$7_{33}$ are supported between a pair of supports 17*a*, 17*b*, wherein first and second suffixes of the cathodes $7_{11}$–$7_{33}$ correspond to the first–third rows and the first–third columns respectively.

In each of the cathodes $7_{11}$–$7_{33}$, for example, an indirectly-heated cathode where oxide is coated on a nickel sleeve or a direct-heated cathode where oxide is coated on a tungsten wire may be used.

Numeral 8 designates a grid electrode group comprising control grids $8_1$–$8_3$ for row selection arranged between the cathode electrode group 7 and the fluorescent display member 5, and these control grids $8_1$–$8_3$ are provided with holes $9_1$–$9_3$ for electron passage so that an electron beam 11 from the cathodes $7_{11}$–$7_{33}$ respectively passes as a divergent beam in the direction corresponding to each of the fluorescent screens 5R, 5G and 5B of the fluorescent display member 5.

Numeral 10 designates a back electrode group comprising stripe-form back electrodes $10_1$–$10_3$ for column selection, respectively arranged to face each of the fluorescent screens 5R, 5G and 5B of the fluorescent display member 5, along the column direction, behind the cathode electrode group 7, on the back plate 3 of the vacuum envelope 1, and these back electrodes $10_1$–$10_3$ are a conductive layer of silver or the like formed on the back plate.

Each of the back electrodes $10_1$–$10_3$ is given either negative potential and 0 V or positive potential of several V with respect to the potential of each of the cathodes $7_{11}$–$7_{33}$ so as to control the electron beam 11 emitted from the cathodes $7_{11}$–$7_{33}$.

Numeral 12 designates a lead wire as an external terminal to extend each electrode of the cathode electrode group 7, the grid electrode group 8 and the back electrode group 10 from the back plate 3 to the outside.

Next, operation will be described. When each of the back electrodes $10_1$–$10_3$ is at negative potential with respect to the potential of the cathodes $7_{11}$–$7_{33}$ since the circumference of these cathodes $7_{11}$–$7_{33}$ is surrounded by the negative potential, electrons from each of the cathodes $7_{11}$–$7_{33}$ cannot flow through the control grids $8_1$–$8_3$ to the accelerating anodes $6_1$–$6_2$, . . . ; thereby, the cutoff state occurs.

In this state, if 0 V or positive potential of several V with respect to the potential of the cathodes $7_{11}$–$7_{33}$ is applied to the back electrodes $10_1$–$10_3$, the electron beam 11 emitted from these cathodes $7_{11}$–$7_{33}$ flows towards the control grids $8_1$–$8_3$.

If the potential of each of the control grids $8_1$–$8_3$ is negative potential with respect to the cathodes $7_{11}$–$7_{33}$ then, the electron beam 11 cannot pass through the electron passing holes $9_1$–$9_3$ of these control grids $8_1$–$8_3$, thereby the electron beam 11 can not flow to the accelerating anodes $6_1$–$6_2$, . . . , and each of the fluorescent screens 5R, 5G and 5B of the fluorescent display member 5 does not emit light.

If the potential of the control grids $8_1$–$8_3$ is a positive potential with respect to the cathodes $7_{11}$–$7_{33}$, the electron beam 11 passes through the electron passing holes $9_1$–$9_3$ of the control grids $8_1$–$8_3$ respectively, thereby each of the fluorescent screens 5R, 5G and 5B emits light.

Consequently, each of the grid electrodes $8_1$–$8_3$ of the grid electrode group 8 arranged in matrix form corresponding to each of the fluorescent screens 5R, 5G and 5B and each of the back electrodes $10_1$–$10_3$ of the back electrode group 10 are selectively controlled to provide drive (dynamic drive); thereby, only the fluorescent screens 5R, 5G and 5B with both electrodes crossing can emit light selectively.

As above described, the fluorescent screens 5R, 5G and 5B composed of the fluorescent materials of the three colors are arranged in matrix form of 3×3 picture elements on the inner surface of the front panel 2 of the vacuum envelope 1, and the cathode electrode group 7, the grid electrode group 8 and the back electrode group 10 are installed corresponding to each of the fluorescent screens 5R, 5G and 5B, thereby a light source display tube of high brightness emission can be obtained.

Consequently, when a large screen color display device is assembled using the light source display tube as a unit, a space between each picture element is shortened in comparison to that using a monochromatic tube having only one picture element, thereby the resolving power can be improved and the number of parts and the number of manufacturing processes can be decreased. Not only can the structure be simplified and the cost be made low, but also the weight of the display device can be reduced.

In the example shown, although the fluorescent screens composed of the fluorescent materials of the three colors, R, G and B are arranged in matrix form of $3\times3$ picture elements on the inner surface of the front panel 2, the example is not limited to this but a fluorescent screen with one fluorescent material forming one picture element may be arranged in matrix form of $m\times n$ picture elements (where m, n are arbitrary positive integers) within the vacuum envelope, and corresponding to this, the arrangement and constitution of the grid electrode group and the back electrode group can be varied.

Also as shown in FIG. 4, a light source display tube is proposed wherein each control grid of the grid electrode group 8 is made of channel form with a U-shaped cross-section, and a shield plate 18 made of metal projecting laterally is attached to each such control grid, thereby stray electrons from the gap between each control grid and the back plate are absorbed by the shield plate 18 and pseudo emission of the fluorescent screen due to the stray electrons is effectively preveated (for example, see Japanese utility model application No. 62-114562).

Further, as disclosed in Japanese patent application laid-open No. 62-241256 for example, an electron passing portion formed on each of the control grids $8_1$–$8_3$ as described above is provided with a dome-shaped mesh portion, thereby electrons emitted from the cathodes $7_{11}$–$7_{33}$ are spread uniformly and can be irradiated uniformly onto the fluorescent screen 5, and the divergent angle of the electron beam 11 can be arbitrarily adjusted corresponding to the curvature of the dome-shaped mesh portion.

Moreover, a light source display tube is proposed where the larger the curvature of the dome-shaped mesh, the larger the divergent angle of the beam, thereby the length of the display tube can be decreased.

As shown in FIGS. 4 and 6, when the channel-shaped control grids $8_1$, $8_2$, . . . with a U-shaped cross-section are arranged on the back plate 3, in order to extend the lead wires 12 for the cathodes $7_{11}$, $7_{12}$, . . . , the back electrode $10_1$ or the like, notched recesses 13 must be formed on both lateral edge portions of the control grid abutting on the back plate 3.

On the other hand, electrons emitted from the cathodes $7_{11}$, $7_{12}$, . . . are attracted by a voltage applied to the control grids $8_1$, $8_2$, . . . and apt to move to both lateral sides of the control grid. Consequently, stray electrons occur from the notched recess 13, thereby pseudo emission may be produced.

Also if a control grid manufactured by means of etching and press forming is used as the channel-shaped control grid with a U-shaped cross-section, when the electric field of $10^8$ V/m or more is applied to the control grid, electron emission is produced due to the field emission phenomenon and pseudo emission may be produced at the fluorescent display member due to the emitted electrons.

In this case, if the control grid is manufactured by drawing and the surface is rounded, the field emission can be prevented, but the working of the dome-shaped mesh portion becomes difficult.

Also as shown in FIG. 6, if a getter 16 is attached to a skirt portion of the accelerating anode $6_1$, a getter film 17 is formed in a wide area of the inner surface of the side plate due to flash of the getter 16 thereby electrical trouble such as shortcircuit or discharge may be produced between the getter film 17 and the control grid $8_1$.

Since the cathodes $7_{11}$–$7_{33}$, the control grids $8_1$–$8_3$, the back electrodes $10_1$–$10_3$ and lead wires for these electrodes are installed on the back plate 3 of the vacuum envelope 1, it is difficult to widen the space between each electrode and the space between each lead wire, thereby electrical trouble may be produced also on account of this condition.

In order for the lead wires 12 for the cathodes $7_{11}$–$7_{33}$, the control grids $8_1$–$8_3$, the back electrodes $10_1$–$10_3$ and the like to be easily taken to the outside, i.e., to the rear side of the back plate 3, as shown in FIG. 7, the vacuum envelope 1 is manufactured in trumpet shape so that the installation area of the back electrodes $10_1$–$10_3$ becomes narrower than that of the fluorescent screen.

In this case, the back electrode $10_1$ and the control grid $8_1$ being next to or near the side plate of the vacuum envelope 1, must be installed not just behind the corresponding fluorescent screen 5R but in a position partially facing the next fluorescent screen 5B, i.e., position-shifted towards the center of the vacuum envelope 1. Consequently, electrons emitted from the cathode $7_{12}$ are guided towards the fluorescent screen 5R and also may be leaked to the next fluorescent screen 5B, thereby pseudo emission may be produced in the fluorescent screen 5B.

Also when electrons emitted from the cathodes $7_{11}$–$7_{33}$ respectively are accelerated by the accelerating anodes $6_1$, $6_2$, . . . , a part thereof charges a top end edge portion of the skirt of the accelerating anode extending towards the back plate, and discharge is produced at the edge portion. Consequently, the divergent beam may not be irradiated uniformly and efficiently from the cathodes $7_{11}$–$7_{33}$ onto the fluorescent screens 5R, 5G, 5B respectively.

SUMMARY OF THE INVENTION

An object of the invention is to provide a light source display tube wherein electrical trouble is minimized and pseudo emission due to stray electrons can be reliably prevented.

Another object of the invention is to provide a light source display tube wherein the function of a control grid is not imparied and the field emission phenomenon can be prevented.

Still another object of the invention is to provide a light source display tube wherein thermoelectrons emitted from a cathode can be irradiated onto a fluorescent screen uniformly and efficiently.

In order to attain the foregoing objects, a light source display tube according to the invention is constituted in that a substrate for mounting a cathode electrode group, a grid electrode group and a back electrode group thereon is provided suspended from a back plate of a vacuum envelope, and the control grid is of channel shape with a U-shaped cross-section and a U-shaped opening end surface abuts an upper surface of the substrate, and sides opposed to a circumferential surface of the substrate are extended to a rear surface of the substrate so as to be in close contact with the circumferential surface, and a lead wire for each of the electrode groups penetrates the substrate or is taken from the rear surface of the substrate through a notched portion of the circumferential surface of the substrate, thereby stray electron current is suppressed and pseudo emission can be reliably prevented.

Also, since a getter is installed on the rear surface of the substrate suspended from the back plate and opposed to the back plate, even if a getter film is formed in a wide area on the back plate due to flash of the getter, the distance between the getter film and each electrode group installed on the substrate is not shortened and there is no fear of producing electrical trouble due to the getter film.

Further, since a lead wire installed on a joint portion between the back plate and a cylindrical side plate and constituting an electrical path for any of the electrodes rises vertically along an inner surface of the cylindrical side plate, and the substrate is supported by an upper end portion of the lead wire so as to be suspended from the back plate, the substrate can be supported firmly without using a special support member.

Since the control grid is provided with an electrode plate manufactured by means of etching and press forming, and a shield body manufactured by drawing, having a hole fitted to a dome-shaped mesh portion of the electrode plate, is constituted integral therewith, the function of the control grid is not impaired and the field emission phenomenon can be securely prevented.

Further, since the control grid being on at least a peripheral portion of the vacuum envelope is slanted so that an electron passing portion is deflected towards the fluorescent screen on the peripheral portion of the vacuum envelope, electrons passing through the electron passing portion collide only on the fluorescent screen of the corresponding peripheral portion, thereby leakage to other neighboring fluorescent screen can be reliably prevented.

Since a flat shadow mask plate provided with a plurality of window holes for passing divergent electron beams is installed as an accelerating plate in front of the fluorescent display member, the divergent electron beams can be irradiated onto the fluorescent screen of the fluorecsent display member uniformly and efficiently.

DETAILED DESCRIPTION OF THE PREFERRED EMBODIMENTS

Preferred embodiments of the invention will now be described in detail referring to the accompanying drawings.

Figure 1:
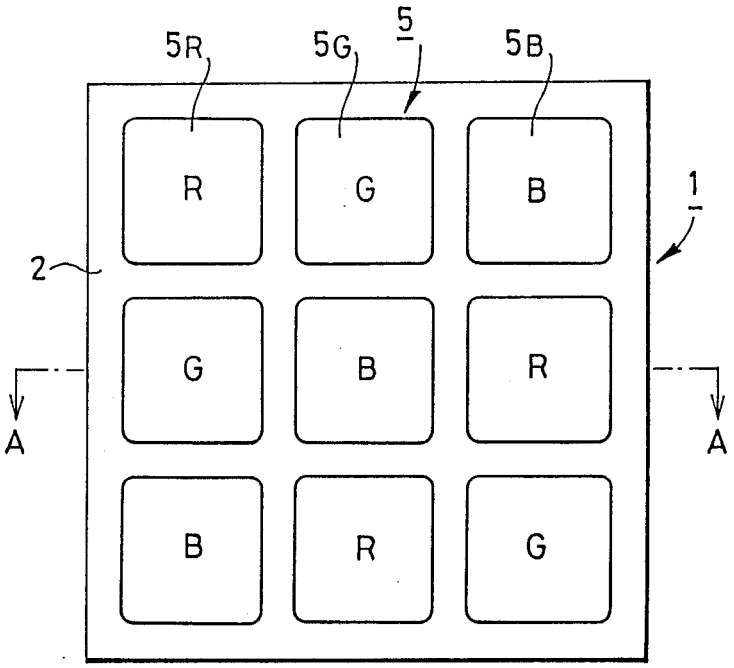
FIG. 1 (PRIOR ART)
FIG. 1 is a plan view of a light source display tube in the prior art.
Figure 2:
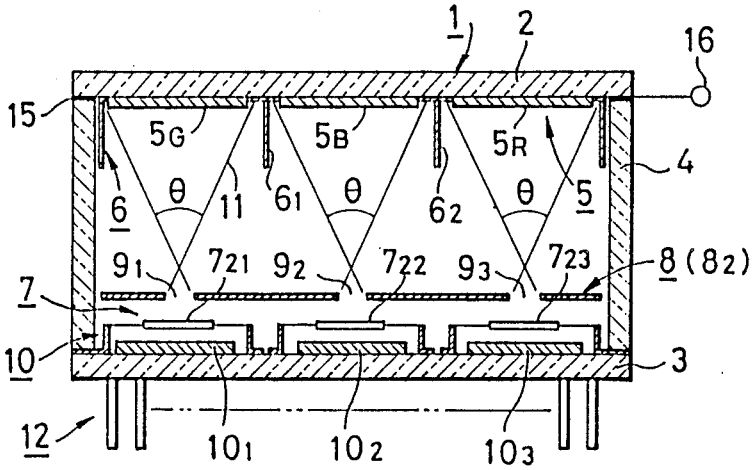
FIG. 2 (PRIOR ART)
FIG. 2 is a transverse sectional view taken along line A—A of FIG. 1.
Figure 3:
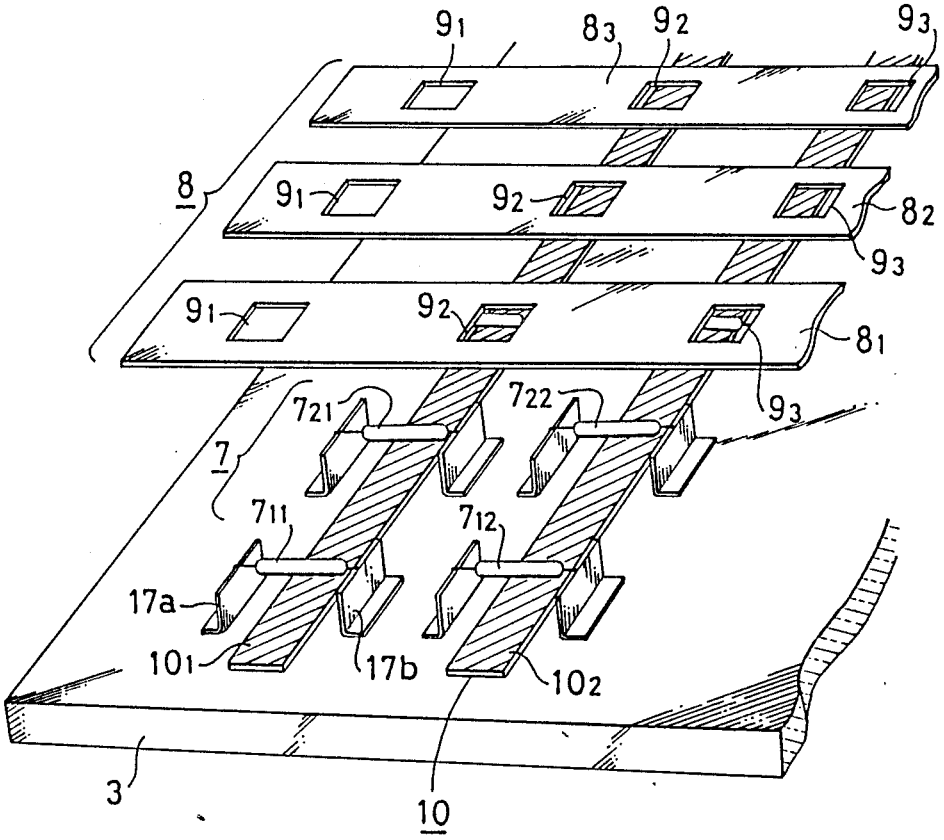
FIG. 3 (PRIOR ART)
FIG. 3 is an exploded perspective view of a part of FIG. 1.
Figure 4:
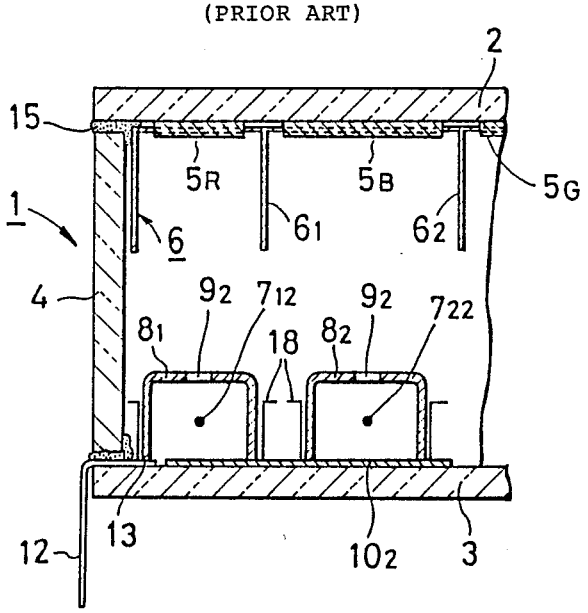
FIG. 4 (PRIOR ART)
FIG. 4 is a transverse sectional view of a light source display tube of another example in the prior art.
Figure 5:
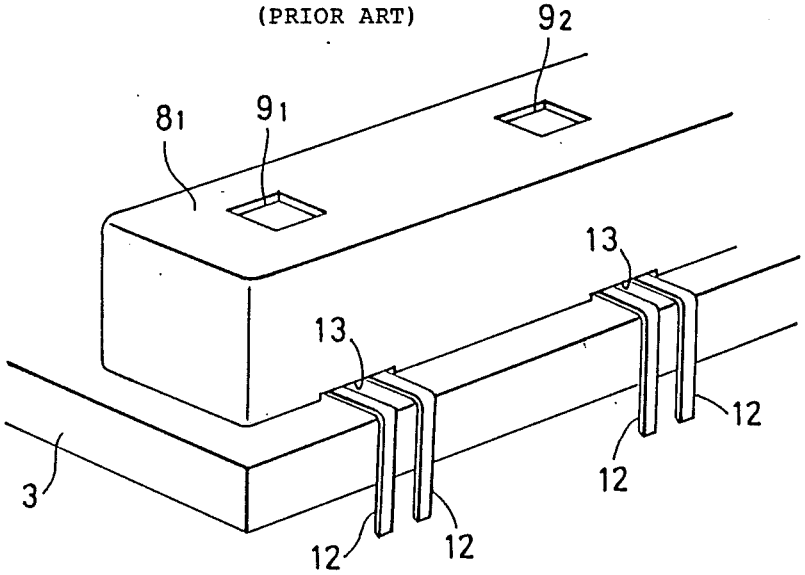
FIG. 5 (PRIOR ART)
FIG. 5 is a view illustrating a transverse section from a direction different by 90 degrees from FIG. 4.
Figure 6:
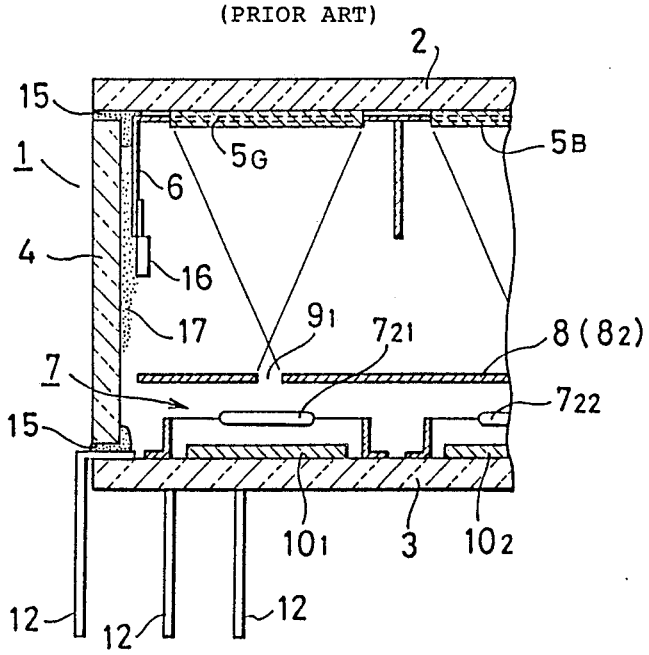
FIG. 6 (PRIOR ART)
FIG. 6 is an exploded perspective view of a part of FIG. 4.
Figure 7:
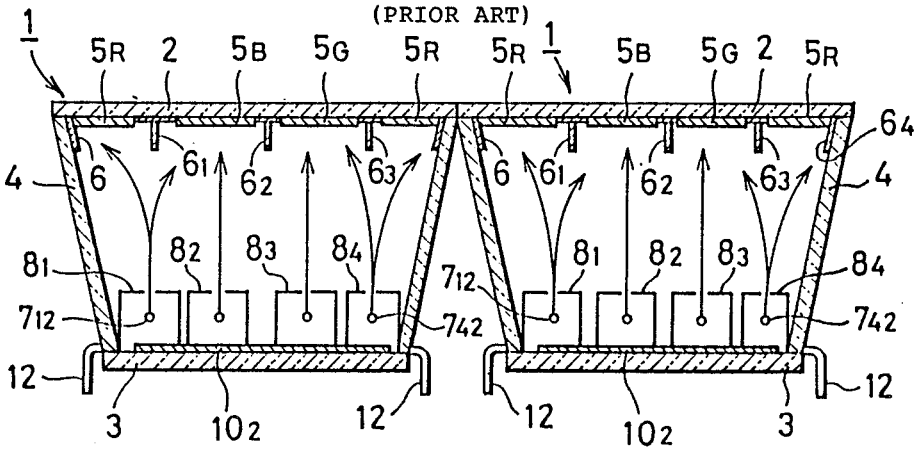
FIG. 7 (PRIOR ART)
FIG. 7 is a transverse sectional view of a light source display tube of still another example in the prior art.
Figure 8:
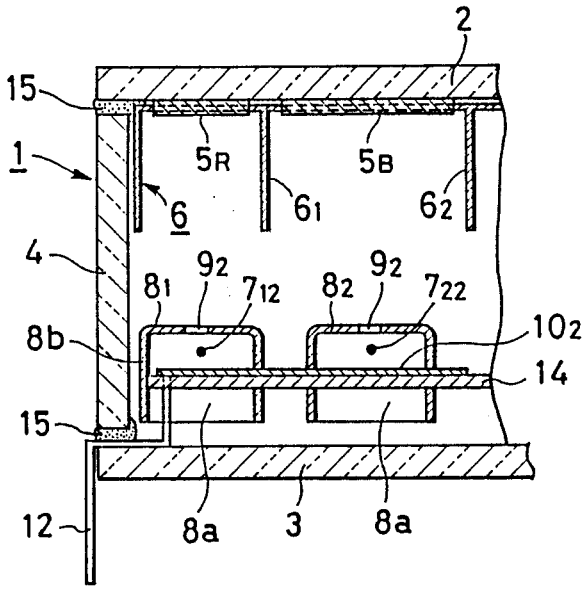
FIG. 8 is a transverse sectional view of a part of a light source display tube as an embodiment of the invention.
Figure 9:
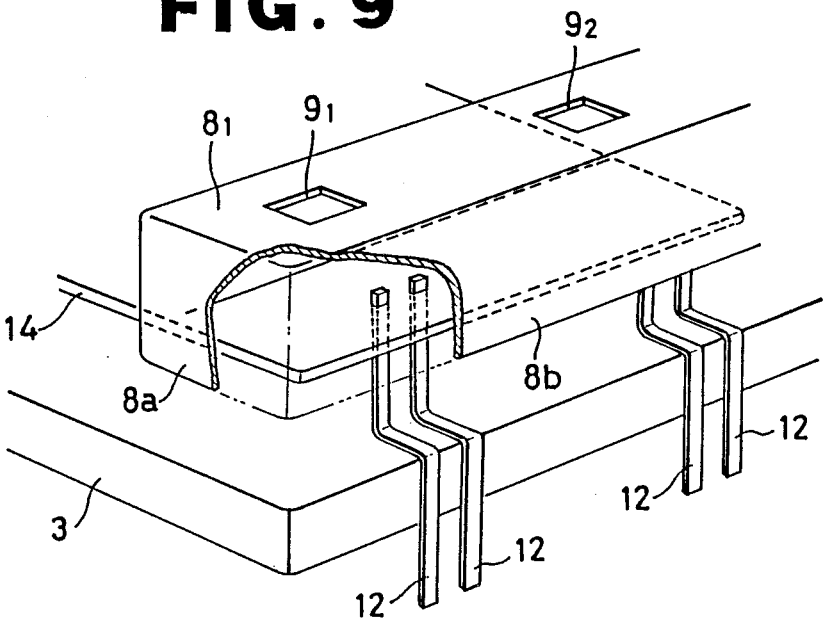
FIG. 9 is a perspective view illustrating the lead wire arrangement of FIG. 8.

In FIG. 8, FIG. 9 where the same parts as those in FIG. 4, FIG. 5 are designated by the same reference numerals, numeral 14 designates a ceramic substrate arranged suspended from a back plate 3, and a cathode electrode group 7, a grid electrode group 8 and a back electrode group 10 are mounted on a surface of the ceramic substrate 14. As a support of the ceramic substrate 14, for example, a lead wire 12 for each electrode group is utilized.

Sides 8*a*, 8*b* of control grids $8_1$–$8_3$ constituting the grid electrode group 8 which are opposed to a circumferential surface of the ceramic substrate 14 are in close contact with the circumferential surfaces and extend to the rear surface of the ceramic substrate.

The lead wire of each electrode group penetrates the ceramic substrate or is introduced through a notched portion (not shown) of the circumferential surface of the substrate to the rear surface of the ceramic substrate, and then introduced through a joint portion between the back plate 3 and the side plate 4 joined by a low melting-point glass 15 to the outside. Depth of notching is defined so that the lead wire 12 is flush with the circumferential surface of the substrate.

Figure 10:
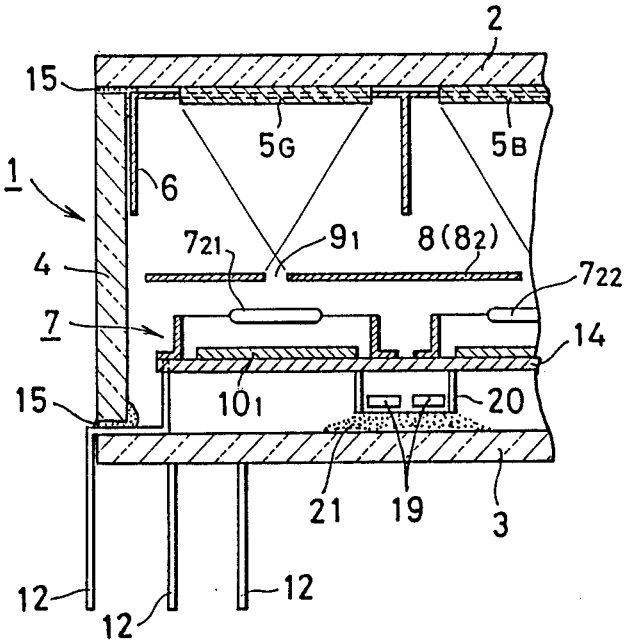
FIG. 10 is a transverse sectional view of a part of a light source display tube as another embodiment of the invention.
Figure 11:
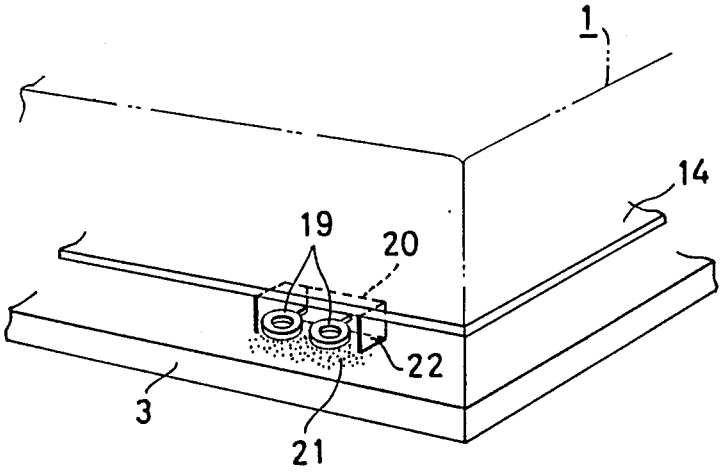
FIG. 11 is a perspective view of a part of FIG. 10.

In FIG. 10, FIG. 11 illustrating another embodiment of the invention, numeral 19 designates a getter mounted on a rear surface of a substrate 14 suspended from a back plate 3 through a mounting plate 20.

According to the above-mentioned constitution, when the getter 19 is flashed, a getter film 21 is formed on the back plate but the distance between the getter film 21 and each electrode group installed on the surface of the substrate is not shortened and electrical trouble is not produced. The getter 19 may be mounted directly on the rear surface of the substrate, or otherwise as shown in FIG. 11, a shield portion 22 of U-shaped form is mounted on the rear surface of the substrate and the getter 19 is installed within the shield portion 22, thereby spread of the getter film 21 can be suppressed and electrical trouble due to the getter film 21 can be prevented more reliably.

Figure 12:
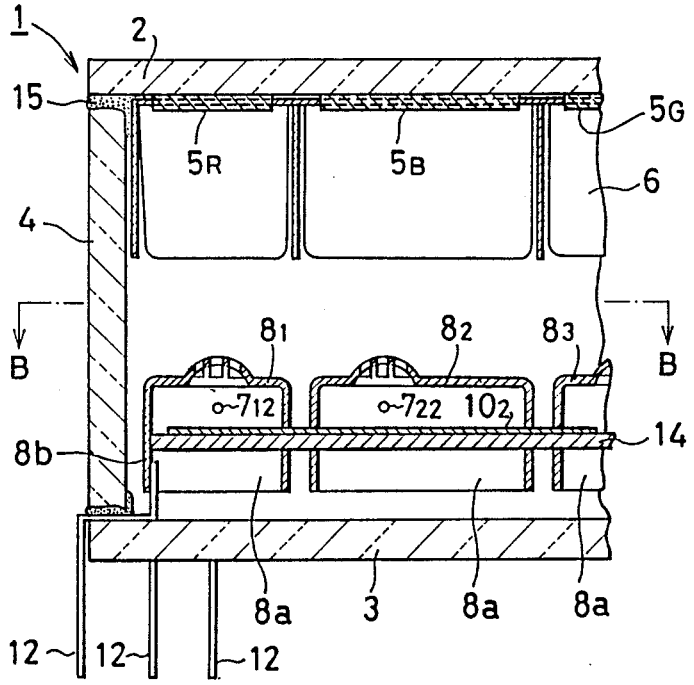
FIG. 12 is a transverse sectional view of a part of a light source display tube as still another embodiment of the invention.
Figure 13:
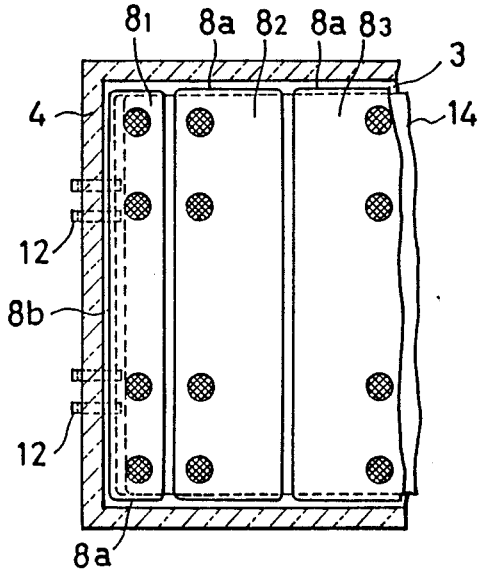
FIG. 13 is a transverse plan view taken along line B—B of FIG. 12.

In FIG. 12, FIG. 13 illustrating a light source display tube as still another embodiment of the invention, lead wires 12 (only one side is shown in the example) installed in a position near at least the four corners of the vacuum envelope 1 are grasped by a joint portion between the back plate 3 and the rectangular side plate 4 of the vacuum envelope 1, and rise vertically along the inner surface of the rectangular side plate in the vacuum envelope 1. Numeral 14 designates a ceramic substrate suspended from the back plate 3 by each lead wire 12, and the lead wire 12 is utilized as a part of lead wires for the back electrodes $10_1$–$10_3$, the cathodes $7_{11}$–$7_{33}$, the control grids $8_1$–$8_3$ or the like installed on the surface of the substrate 14.

When the channel-shaped control grids $8_1$–$8_3$ with a U-shaped cross-section are mounted on the substrate 14 as shown in the figure, sides 8*a*, 8*b* of the control grid opposed to the circumferential surface of the substrate are extended to the rear side of the substrate 14 so as to surround the substrate 14, and the lead wire 12 is fixed to the extended portion 8*b* and supports the substrate 14. Also the lead wire 12 may be directly fixed to the substrate 14 and support it.

Figure 14:
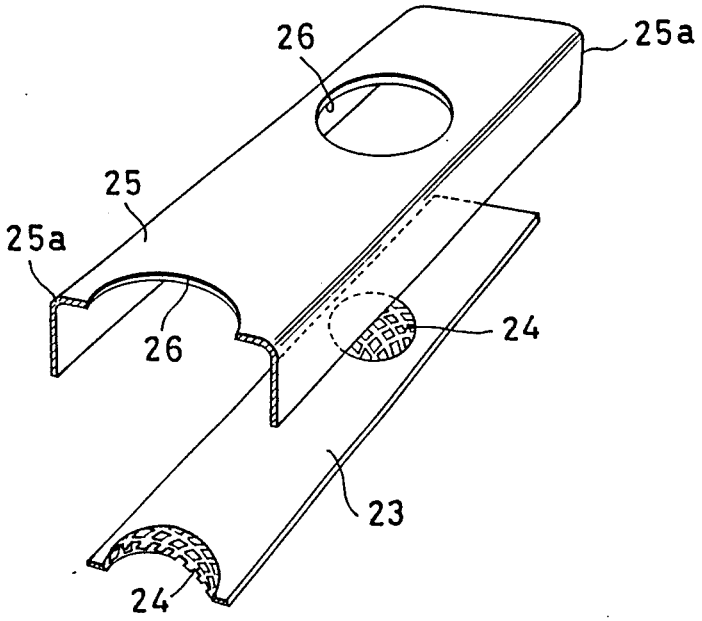
FIG. 14 is an exploded perspective view illustrating a control grid.
Figure 15:
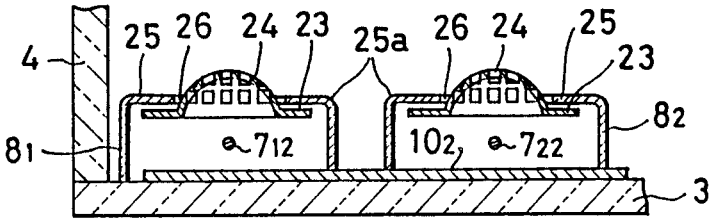
FIG. 15 is a transverse sectional view of the control grid of FIG. 14 in the assembled state.

In FIG. 14, FIG. 15 illustrating constitution of the control grid, numeral 23 designates an electrode plate with dome-shaped mesh portions 24 manufactured at substantially regular intervals by means of etching and press forming, and numeral 25 designates a shield body manufactured by drawing and having holes 26 bored at substantially regular intervals to be fitted to the dome-shaped mesh portions of the electrode plate 23.

The electrode plate 23 and the shield body 25 are combined by fitting the dome-shaped mesh portion 24 to the hole 26, and integrated, for example, by spot welding or the like at part of the overlaid portion, thereby the control grid is formed.

Consequently, the electron beam emitted from the cathodes $7_{11}$–$7_{33}$ is diffused by the dome-shaped mesh portion 24 and irradiated to the fluorescent screens 5R, 5G, 5B, thereby function of the control grid is not impaired. Since the shield body 25 is worked by drawing, the bent portions 25*a* on both sides are made arc shaped, and even if voltage of 10 KV or more is applied in the anode, the electric field at the neighborhood of the shield body 25 does not become $10^8$ V/m or more and the field emission phenomenon is not produced.

Figure 16:
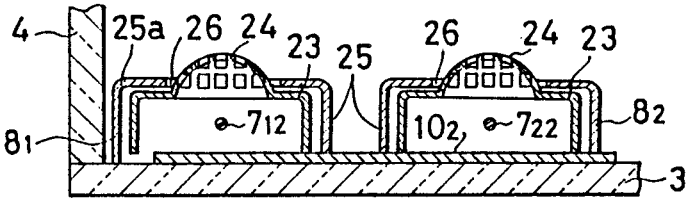
FIG. 16 is a transverse sectional view illustrating another control grid in the assembled state.

FIG. 16 shows another embodiment of the invention where the electrode plate 23 has both side portions bent at nearly right angles and constituted into a U-shaped cross-section. In the constitution of the embodiment, electron emission from the cathodes $7_{11}$–$7_{33}$ can be stabilized using the small back electrodes $10_1$–$10_3$ having nearly the same width as that of the U-shaped opening of the electrode plate 23, and the same voltage from the same power source is applied to both the electrode plate 23 and the shield body 25 and equal potential exists between both members, thereby stray electrons from the electrode plate 23 to the outside can be suppressed and the electron beam passing through the dome-shaped mesh portion 24 can be stabilized.

Figure 17:
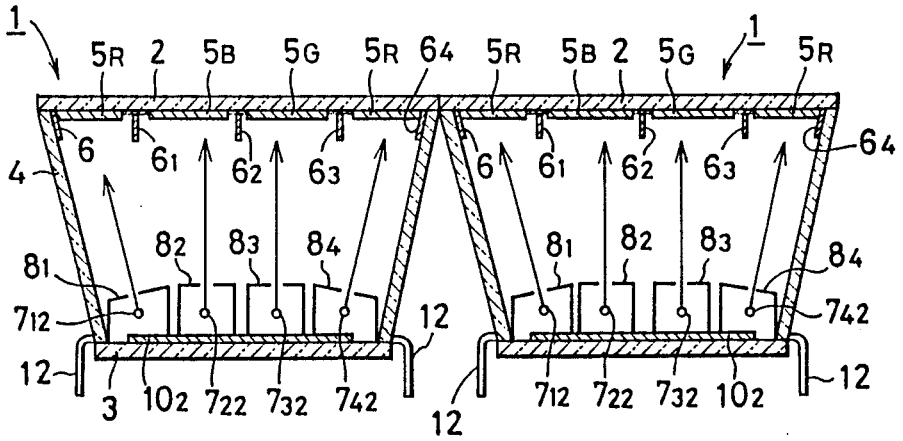
FIG. 17 is a transverse sectional view of a light source display tube as another embodiment of the invention.

In FIG. 17 illustrating another embodiment of the invention, channel-shaped control grids $8_1$–$8_4$ are installed so as to surround cathodes $7_{11}$, $7_{12}$, $7_{13}$, $7_{14}$ respectively. Among these, the control grids $8_1$, $8_4$ on peripheral portions have an inclination of the upper surface so that electrons passing through the control grids $8_1$, $8_4$ are deflected towards the fluorescent screens 5R also on the peripheral portions. That is, a mesh or an opening provided as an electron passing portion on the control grids $8_1$, $8_4$ has the proper inclination to be opposed to the fluorescent screen at the peripheral portion.

If the cathode electrode at the outer circumferential side generates electrons for the fluorescent display, the electrons are within the control grids $8_1$, $8_4$ and do not leak to the outside, and the potential gradient corresponding to the inclination is produced on the periphery of the control grids $8_1$, $8_4$. Consequently, from the electron passing portion 9 opening at this inclination, the electrons are emitted in the perpendicular direction with respect to the inclination and irradiated to the fluorescent screen 5R of the corresponding periphery. Consequently, the electrons are not incident to the neighboring fluorescent screens 5G, 5B as in the prior art, thereby emission in each fluorescent screen can be controlled with high accuracy. Other control grids $8_2$, $8_3$ demonstrate similar function and operation as the control grid in the prior art.

Although the embodiment has been described in the case that only the control grids $8_1$, $8_4$ at the outermost peripheral portion are given the inclination, other control grids $8_2$, $8_3$ at the inside from the control grids $8_1$, $8_4$ may be given an inclination varying gradually and similar effects to the embodiment can be obtained.

Figure 18:
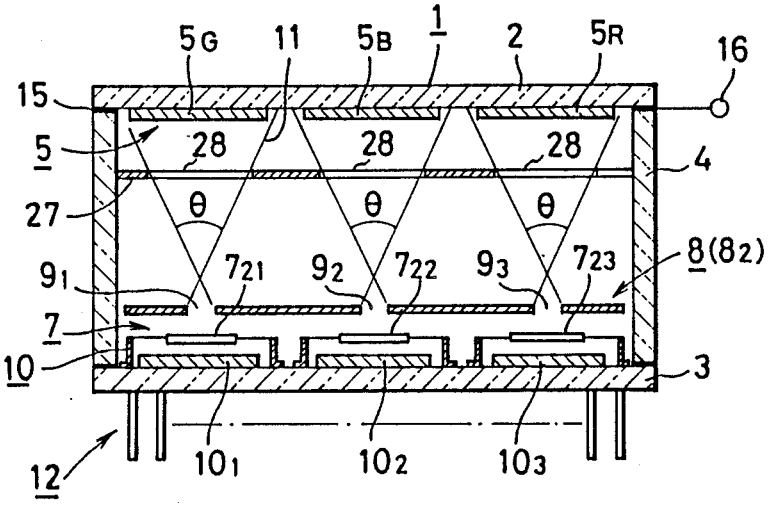
FIG. 18 is a transverse sectional view of a light source display tube as still another embodiment of the invention.

In FIG. 18 illustrating still another embodiment of the invention, numeral 27 designates an accelerating anode, and the accelerating anode 27 comprises one conductive plate on which a plurality of window holes 28 to transmit divergent beams from each of the cathodes $7_{11}$–$7_{13}$ are provided. The accelerating anode 27, as a shadow mask plate corresponding to each of the cathodes $7_{11}$–$7_{13}$, is installed between each of the fluorescent screens 5R, 5G, 5B and the control grids $8_1$–$8_3$, and connected electrically to each of the fluorescent screens 5R, 5G, 5B and to an aluminium film (not shown) for preventing electron reflection provided on the inner surface of the front panel 2.

If electrons are emitted from any of the cathodes $7_{11}$–$7_{13}$, through any of the corresponding control grids $8_1$, $8_3$ a divergent beam of electrons passes through the corresponding window hole 28, and is subjected to the electric field of high voltage and accelerated while passing through the window hole 28, and irradiated onto the prescribed fluorescent screen 5R, 5G, or 5B. In this case, since the accelerating anode 27 as a whole is of flat plate form, the potential gradient to the divergent beam becomes wholly uniform, thereby the divergent beam is not concentrated to a part of the accelerating anode 27. Consequently, the divergent beam is irradiated efficiently to each of the fluorescent screens 5R, 5G, 5B respectively. As a result, a picture to be obtained on the color display device can be displayed clearly and brightly.

In addition, the window hole 28 can be arbitrarily selected to be round shape, rectangular shape or the like.

According to the invention as above described, a channel-shaped control grid with a U-shaped cross-section abuts an upper surface of a substrate and sides of the control grid opposed to a circumferential surface of the ceramic substrate are in close contact with the circumferential surface and extend to a rear surface of the substrate, and a lead wire for each of the electrode groups mounted on the ceramic substrate penetrates the ceramic substrate or is taken through a notched portion of the circumferential surface of the substrate, thereby stray electrons from portions other than an electron passing portion of the control grid are suppressed and pseudo emission can be reliably prevented.

Also, the substrate is installed suspended from the back plate of the vacuum envelope, and various sorts of electrode groups such as a back electrode group, a cathode electrode group, a grid electrode group or the like, are installed on the surface of the substrate, and a getter is installed on the rear surface of the substrate, thereby a getter film due to flash of the getter is formed on the back plate and electrical trouble due to the getter film can be reliably prevented. Consequently, flushing of the getter can be performed sufficiently, and the of vacuum degree within the vacuum envelope can be highly increased by the getter and the reliability can be improved.

Further, a lead wire grasped by a joint portion between the back plate and a cylindrical side plate of the vacuum envelope rises vertically along an inner surface of the cylindrical side plate, and the substrate is supported and fixed by an upper end portion of the lead wire so as to be suspended from the back plate, thereby a special support member for supporting the substrate is not required. Also since the back electrode, the cathode, the control grid and lead wires for these electrodes can be installed utilizing both surfaces of the substrate, the space between each electrode and the space between each lead wire can be widened and electrical trouble can be minimized.

Since a control grid is constituted by assembling an electrode plate with dome-shaped mesh portions formed at substantially regular intervals by means of etching together with press forming and a shield plate manufactured by drawing and having holes bored to be fitted to the dome-shaped mesh portions, the field emission phenomenon can be reliably prevented.

Also, since at least the control grid on a peripheral portion of the vacuum envelope is slanted so that passing electrons are deflected towards the fluorescent screen on the peripheral portion, electrons emitted from the cathode through the control grid to the peripheral portion can be accurately deflected and projected towards the intended fluorescent screen on the peripheral portion. Consequently, stray electrons directed to other fluorescent screens can be prevented and high quality display becomes possible throughout the large screen display as a whole.

Further, since an accelerating anode of plate form having a plurality of window holes for accelerating and transmitting a divergent beam from the cathode is installed, the divergent beam can be prevented from being concentrated to a part of the accelerating anode. Consequently, the irradiation efficiency of the divergent beam to the fluorescent screen can be improved significantly.

What is claimed is:

1. A light source display tube comprising:

a vacuum envelope having a light-transmissive front panel on a front opening of a rectangular side plate and a back plate on a rear opening thereof both hermetically sealed;

a fluorescent display member formed by arranging fluorescent screens in matrix form onto an inner surface of said front panel;

an anode electrode group comprising a plurality of accelerating anodes arranged on a periphery of each of said fluorescent screens;

a cathode electrode group comprising cathodes for electron emission arranged independently corresponding to each of said fluorescent screens;

a grid electrode group comprising a plurality of control grids arranged between said cathode electrode group and said fluorescent display member in a direction of rows (or columns) corresponding to each fluorescent screen, in matrix form, of said fluorescent display member and having an electron passing hole for passing electrons from each of the cathodes as a divergent beam; and a back electrode group comprising a plurality of back electrodes arranged at a rear surface side of said cathode electrode group in a direction of columns (or rows), corresponding to each fluorescent screen of said fluorescent display member, wherein each control grid of said grid electrode group and each back electrode of said back electrode group together constitute a matrix, characterized in that a substrate for mounting said cathode electrode group, said grid electrode group and said back electrode group thereon is installed suspended from the back plate of said vacuum envelope, and each of said control grids is made channel-shaped with a U-shaped cross-section, a U-shaped opening end surface abutting on an upper surface of the substrate and sides of at least one of said control grids opposing a circumferential surface of the substrate in close contact with the circumferential surface and extending to the rear surface of the substrate, and wherein a lead wire for each of the electrode groups is introduced from a rear surface side of said substrate through a through-hole or a notched portion of the substrate.

2. A light source display tube as set forth in claim 1, wherein said cathode is an indirectly-heated cathode where oxide is coated on a nickel sleeve or a direct-heated cathode where oxide is coated on a tungsten wire.

3. A light source display tube as set forth in claim 1, wherein said back electrode is a conductive layer formed on the substrate.

4. A light source display tube as set forth in claim 1, wherein a getter is installed on a rear surface of the substrate so that a getter film is formed on the back plate.

5. A light source display tube as set forth in claim 4, wherein said getter is installed through a mounting plate to the rear surface of the substrate.

6. A light source display tube as set forth in claim 1, wherein a lead wire is installed on a joint portion between the back plate and the rectangular side plate of the vacuum envelope, and the lead wire rises in parallel to the rectangular side plate, and the substrate is supported on the upper end portion of the lead wire suspended from the back plate.

7. A light source display tube as set forth in claim 6, wherein a channel-shaped control grid with a U-shaped cross-section is mounted on the substrate, and sides of the control grid oppose the circumferential surface of the substrate and extend to the rear side of the substrate, the extended portion being supported by an upper end portion of the lead wire.

8. A light source display tube comprising:

a vacuum envelope having a light-transmissive front panel on a front opening of a rectangular side plate and a back plate on a rear opening thereof both hermetically sealed;

a fluorescent display member formed by arranging fluorescent screens in matrix form onto an inner surface of said front panel;

an anode electrode group comprising a plurality of accelerating anodes arranged on a periphery of each of said fluorescent screens;

a cathode electrode group comprising cathodes for electron emission arranged independently corresponding to each of said fluorescent screens;

a grid electrode group comprising a plurality of control grids arranged between said cathode electrode group and said fluorescent display member in a direction of rows (or columns), corresponding to each fluorescent screen, in matrix form, of said fluorescent display member and having an electron passing hole for passing electrons from each of the cathodes as a divergent beam; and a back electrode group comprising a plurality of back electrodes arranged at a rear surface side of said cathode electrode group in a direction of columns (or rows), corresponding to each fluorescent screen of said fluorescent display member, wherein each control grid of said grid electrode group and each back electrode of said back electrode group constitute a matrix, characterized in that said control grid is composed of an electrode plate with dome-shaped mesh portions as an electron passing portion, formed at substantially regular intervals by means of etching and press forming, and a shield body with a U-shaped cross-section having holes to be fitted to the dome-shaped mesh portions and manufactured by drawing to cover said electrode plate.

9. A light source display tube comprising:

a vacuum envelope having a light-transmissive front panel on a front opening of a rectangular side plate and a back plate on a rear opening thereof both hermetically sealed;

a fluorescent display member formed by arranging fluorescent screens in matrix form onto an inner surface of said front panel;

an anode electrode group comprising a plurality of accelerating anodes arranged on a periphery of each of said fluorescent screens;

a cathode electrode group comprising cathodes for electron emission arranged independently corresponding to each of said fluorescent screens;

a grid electrode group comprising a plurality of control grids arranged between said cathode electrode group and said fluorescent display member in a direction of rows (or columns), corresponding to each fluorescent screen, in matrix form, of said fluorescent display member and having an electron passing hole for passing electrons from each of the cathodes as a divergent beam; and a back electrode group comprising a plurality of back electrodes arranged at a rear surface side of said cathode electrode group in direction of columns (or rows), corresponding to each fluorescent screen of said fluorescent display member, wherein each control grid of said grid electrode group and each back electrode of said back electrode group together constitute a matrix, characterized in that part of at least a control grid on a peripheral portion of the vacuum envelope is slanted relative to the fluorescent screen so that passing electrons are deflected towards the fluorescent screen of the peripheral portion.

10. A light source display tube comprising:

a vacuum envelope having a light-transmissive front panel on a front opening of a rectangular side plate and a back plate on a rear opening thereof both hermetically sealed;

a fluorescent display member formed by arranging fluorescent screens in matrix form onto an inner surface of said front panel;

an anode electrode group comprising a plurality of accelerating anodes arranged on a periphery of each of said fluorescent screens;

a cathode electrode group comprising cathodes for electron emission arranged independently corresponding to each of said fluorescent screens;

a grid electrode group comprising a plurality of control grids arranged between said cathode electrode group and said fluorescent display member in a direction of rows (or columns), corresponding to each fluorescent screen, in matrix form, of said fluorescent display member and having an electron passing hole for passing electrons from each of the cathodes as a divergent beam; and a back electrode group comprising a plurality of back electrodes arranged at a rear surface side of said cathode electrode group in a direction of columns (or rows), corresponding to each fluorescent screen of said fluorescent display member, wherein each control grid of said grid electrode group and each back electrode of said back electrode group together constitute a matrix, characterized in that said accelerating anodes are formed by a flat shadow mask plate installed in front of the fluorescent display member and having a plurality of window holes for passing a divergent beam to excite a fluorescent screen.

* * * * *

UNITED STATES PATENT AND TRADEMARK OFFICE

CERTIFICATE OF CORRECTION

PATENT NO. : 4,972,116

DATED : November 20, 1990

INVENTOR(S) : Kazunori TATSUDA et al.

It is certified that error appears in the above-identified patent and that said Letters Patent is hereby corrected as shown below:

On the title page, item [75] Inventors: please change ninth inventor's name to read --Shuji Iwata--.

Signed and Sealed this

Seventh Day of April, 1992

*Attest:*

HARRY F. MANBECK, JR.

*Attesting Officer*

*Commissioner of Patents and Trademarks*